US006022271A

United States Patent [19]

Biondo

[11] Patent Number: 6,022,271

[45] Date of Patent: Feb. 8, 2000

[54] FIRE RESPONSIVE CLOSING AIR VENT

[76] Inventor: Vincent C. Biondo, 4 Kinney Rd., Milford, N.J. 08848

[21] Appl. No.: 08/888,377

[22] Filed: Jul. 7, 1997

[51] Int. Cl.[7] ..... F24F 11/053

[52] U.S. Cl. ..... 454/369

[58] Field of Search ..... 137/74; 454/257, 454/357, 364

[56] References Cited

U.S. PATENT DOCUMENTS

| | | | |
|---|---|---|---|
| 2,718,187 | 9/1955 | Frisby . | |
| 2,755,728 | 7/1956 | Frisby . | |
| 3,076,469 | 2/1963 | Averill | 137/74 |
| 3,687,055 | 8/1972 | Dean, Jr. et al. | 454/369 |
| 3,899,156 | 8/1975 | McCabe . | |
| 4,562,853 | 1/1986 | Tschirky et al. . | |
| 4,667,581 | 5/1987 | Hovland . | |
| 5,797,321 | 8/1998 | Shibata | 101/246 |

FOREIGN PATENT DOCUMENTS

| | | | |
|---|---|---|---|
| 53-64942 | 6/1978 | Japan . | |
| 1416763 | 12/1975 | United Kingdom | 454/369 |
| 2141428 | 1/1985 | United Kingdom | 454/369 |

*Primary Examiner*—Harold Joyce
*Attorney, Agent, or Firm*—Kenneth P. Glynn, Esq.

[57] ABSTRACT

A fire responsive, closing air vent includes a main frame enclosing an air flow passageway with a hingeable cover connected to the main frame which can open and close. The frame has a mechanism for biasing the cover towards the closed position and a preformed mass of material, e.g. meltable wax positioned at least in part between the frame and the cover to hold the cover in the open position. The material is at least partially moveable (e.g., shrinkable or meltable) in response to an increase in ambient temperature in excess of 140° F. so as to cease from holding the cover in an open position and permitting the weight to close the cover. In one embodiment, the vent is made up of a flat plate and a subframe for insertion into a building structure and is positioned at right angles to the flat plate. In another embodiment, the main frame of the closing air vent has a plurality of air passageways and the cover is capable of covering all of the air passageways.

8 Claims, 6 Drawing Sheets

FIRE RESPONSIVE CLOSING AIR VENT

BACKGROUND OF THE INVENTION

1. Field of the Invention

The present invention relates to vents for air circulation, particularly from outdoors to indoors such as home soffit vents, barn vents, building vents and the like. More specifically, it relates to such vents that close in response to elevated heat with the objective being to have a closing response to the heat of fire to reduce or eliminate vent based updrafting.

2. Information Disclosure Statement

The following is representative of mechanical systems with ventilator structures:

U.S. Pat. No. 2,718,187 issued to Frisby describes a ventilator comprising a frame member which defines a central opening through which air may pass, a screen member, of substantially the same dimensions as those of the frame, attached to the frame and covering the central opening, a cover plate of substantially the same dimensions as that of the central opening pivotally mounted on the frame over the central opening. The cover plate is spring biased to selectively assume either one of two stable equilibrium positions with respect to the central opening, the frame defining first and second bores extending therethrough and located respectively on opposite sides of the pivotal mounting point whereby actuating forces may be selectively brought to bear through the bores onto the cover plate to cause the cover plate to assume selectively said stable equilibrium positions.

U.S. Pat. No. 2,755,728 issued to Frisby describes a ventilator which includes a rectangular frame having a rectangular central opening. There are ledges on one side of the frame along opposed edges thereof, a screen, means for fastening the screen to the ledges in parallel relation to the frame, the frame defining holes therethrough perpendicular to the plane of the screen whereby the frame may be mounted on a base with the screen held between the frame and the base. The ledges are narrower than the frame whereby there are spaces between the screen and the frame along the inner walls of the ledges, a spring mounted on one of the ledges and extending into the space adjacent that ledge toward the opposing ledge, and a rectangular closure plate having one dimension slightly greater than the distance from the spring to the opposing ledge and having its other dimension slightly less than the complementary dimension of the rectangular opening and being held by said ledges under the action of the spring.

U.S. Pat. No. 3,899,156 issued to McCabe describes a fire damper for use in small openings which includes a single blade articulated about a hinge within a frame. The blade is movable between an open and closed position. In the open position a fusible link and strap retain the blade. When the link is released a negator extension-type spring mounted on the frame forces the blade to close the opening through the frame. A blade lock mounted on the blade engages the frame to retain the blade in the closed position.

U.S. Pat. No. 4,562,853 issued to Techirkey et al describes a plurality of valve structures which are incorporated in a drill pipe string for drilling a well into the earth utilizing air as the drilling fluid. A valve is located in the drill pipe string just above the drilling bit, and an additional valve or valves are located in upwardly spaced relation within the drill collar string. Each of the valves has a valve member held in a position allowing the flow of air through the valve by a fusible support, and when the support melts, the valve member will shift to a position closing the valve. The valve just above the bit is combined with a float valve to prevent the upward flow of fluid into the drill string, while the valve or valves spaced upwardly in the drill collar string are full opening valves which allow the running of instruments through the drill string to selected locations above the bit. The additionally upwardly spaced valve or valves include a flap held in a position to one side of the bore through the valve body by a fusible retainer. When the fusible retainer melts, releasing the flap, the flap seats on the sleeve to shut off the flow of fluid through the valve and through the drill pipe string and cause an increase in pressure of air above the closed valve.

U.S. Pat. No. 4,667,581 issued to Hovland describes a ventilator for attachment to a building soffit which is opened or closed automatically in response to a critical wind velocity. The ventilator includes a damper hingeably attached thereto which is acted upon by a wind of a predetermined velocity to cover the ventilator opening into the building and thereby prevents the introduction of wind-blown snow, rain or other particulate matter into the building.

United Kingdom Patent No. 1,416,763 describes a thermally actuable fire protection valve which is for a ceiling outlet in an air-conditioning installation, the valve includes an air box which has a laterally directable air inlet opening and a fire resistant flap adapted to close the outlet opening, one end of the flap being hinged to the side of the box opposite the inlet opening and the flap being held inclined to the air outlet opening, the open position within the box, by a thermally releasable arresting device.

Japanese Patent No. 53-64,942 describes a fire prevention damper to be opened and closed which is provided within the body, which is isolated from the external air, and it is mechanically held in an open state via temperature fuse. The temperature fuse of this fire prevention damper is constituted by a shaft, a cylinder and a heat reception member, with the shaft and cylinder secured to each other by soldering.

United Kingdom Patent No. 2,141,928A issued to Tanner describes a ventilator device which includes a casing having one or more openings for passage of ventilation air therethrough, a shutter within the casing and normally held retracted from the one or more openings, first means for urging the shutter to a position to close the one or more openings, and second means actuation of which releases the shutter to cause it to be moved by the first means to close the one or more openings.

Notwithstanding the prior art, the present invention is neither taught nor rendered obvious thereby.

SUMMARY OF THE INVENTION

A fire responsive, closing air vent includes a main frame enclosing an air flow passageway with a hingeable cover connected to the main frame which can open and close. The frame has a mechanism for biasing the cover towards the closed position and has a material which is meltable, shrinkable or deformable in response to heat above a predetermined temperature which is positioned at least in part between the frame and the cover to hold the cover in the open position. In one embodiment, the material which is meltable is made up of a wax which is at least partially moveable in response to an increase in ambient temperature in excess of 140° F. so as to cease from holding the cover in an open position and permitting the weight to close the cover. In another embodiment, the vent is made up of a flat plate and subframe for insertion into a building structure and is positioned at right angles to the flat plate and the main frame of the closing air vent has a plurality of air passageways and the cover is capable of covering all of the air passageways. In yet another embodiment, the fire responsive, closing air vent would generally be made up of a thermally expandable and contractible bimetallic component. This device uniquely causes automatic closure of covers attached to heat above predetermined temperatures so as to prevent fire from entering the enclosed space to which the vent is connected and/or to reduce the flow of air to a fire and will subsequently make the fire burn slower and reduce spreading.

BRIEF DESCRIPTION OF THE DRAWINGS

The present invention should be more fully understood when the specification herein is taken in conjunction with the drawings appended hereto wherein.

DETAILED DESCRIPTION OF THE PRESENT INVENTION

The present inventions involves the use of fire responsive materials to maintain in an open position vents which have covers which are otherwise biased to a closed position. Thus, vents which have previously been inserted into buildings for passive air circulation which constituted simple grill work would previously permit air intake during a fire and create what might be characterized as a flue affect, chimney affect or bellows affect. This phenomenon fed more and more air to a fire and made the fire burn faster and spread quicker. Additionally, and in many fire situations, more importantly, the present invention prevents fire from entering the room, attic or other enclosed space to which the vent is connected. The present invention devices uniquely cause automatic closure of covers attached to such vents when exposed to heat above predetermined temperatures.

Figure 1:
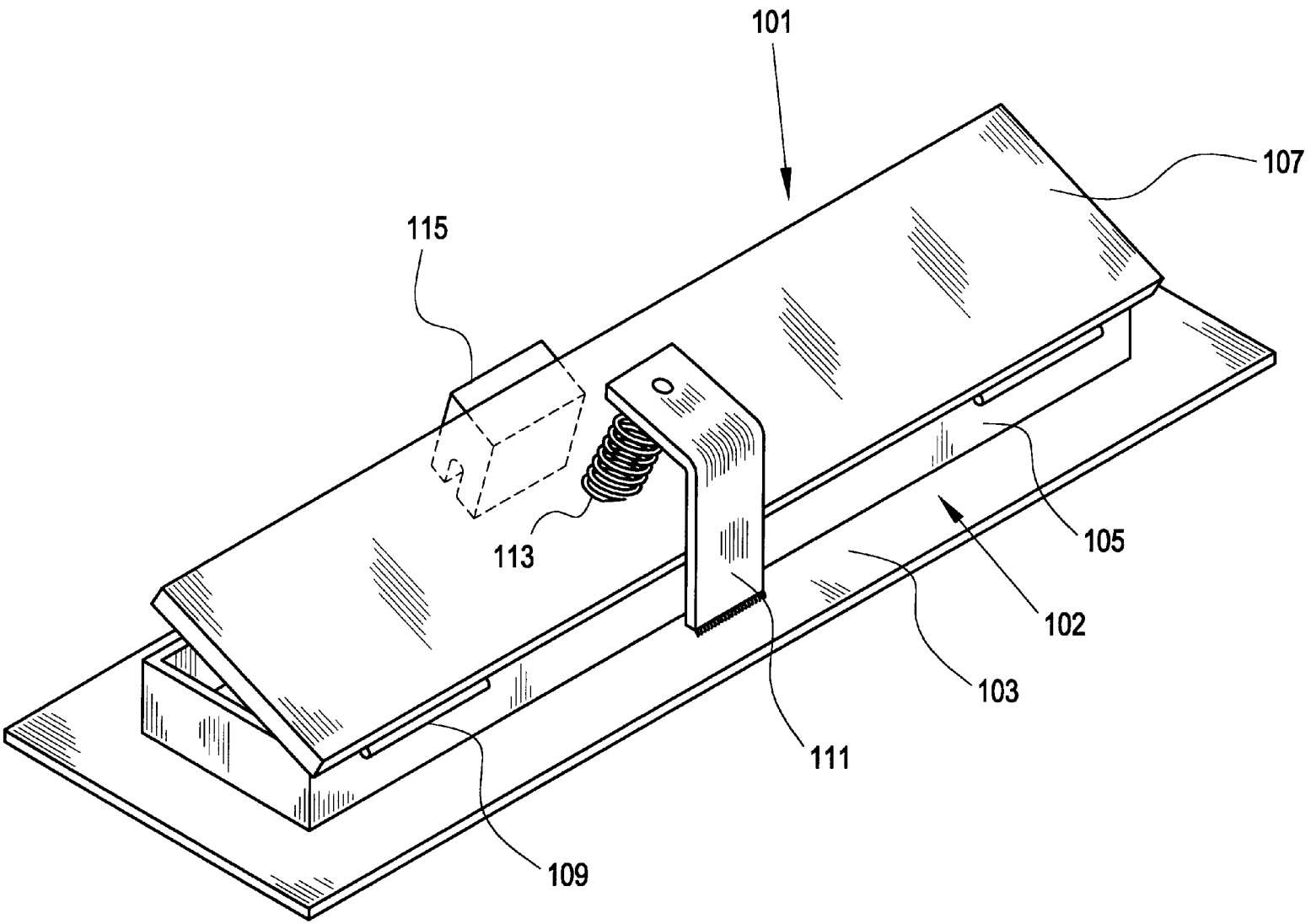
FIG. 1 illustrates a diagram of the present invention fire responsive, closing air vent.

Referring to FIG. 1, there is shown a present invention fire responsive, closing air vent 101. It includes a main frame 102 which, in this case, is a flat plate 103 with a rectangular airflow passageway and also includes a subframe 105 which is a rectangular box with side walls positioned at right angles to said flat plate 103. There is also included a cover 107 which is connected to main frame 102 at subframe 105 via hinges, such as hinge 109. There is a metal bracket 111 connected to mainframe 102 and straddling cover 107. Connected thereto is a spring 113 which pushes against cover 107 to force it downwardly to a second, closed position. However, wax block 115 is nested on the edge of subframe 105 and under cover 107 to push cover 107 upwardly to a first, open position, as shown, with spring 113 at least partially compressed. Vent 101 may be installed for air passage in any structure requiring this and will function to retard or prevent rapid updrafts during a fire when the heat melts wax block 115 such that spring 113 moves cover 107 into its second, closed position. This will prevent a flue effect through the vent and may reduce the intensity of a fire and/or slow down the spreading of a fire.

Figure 2:
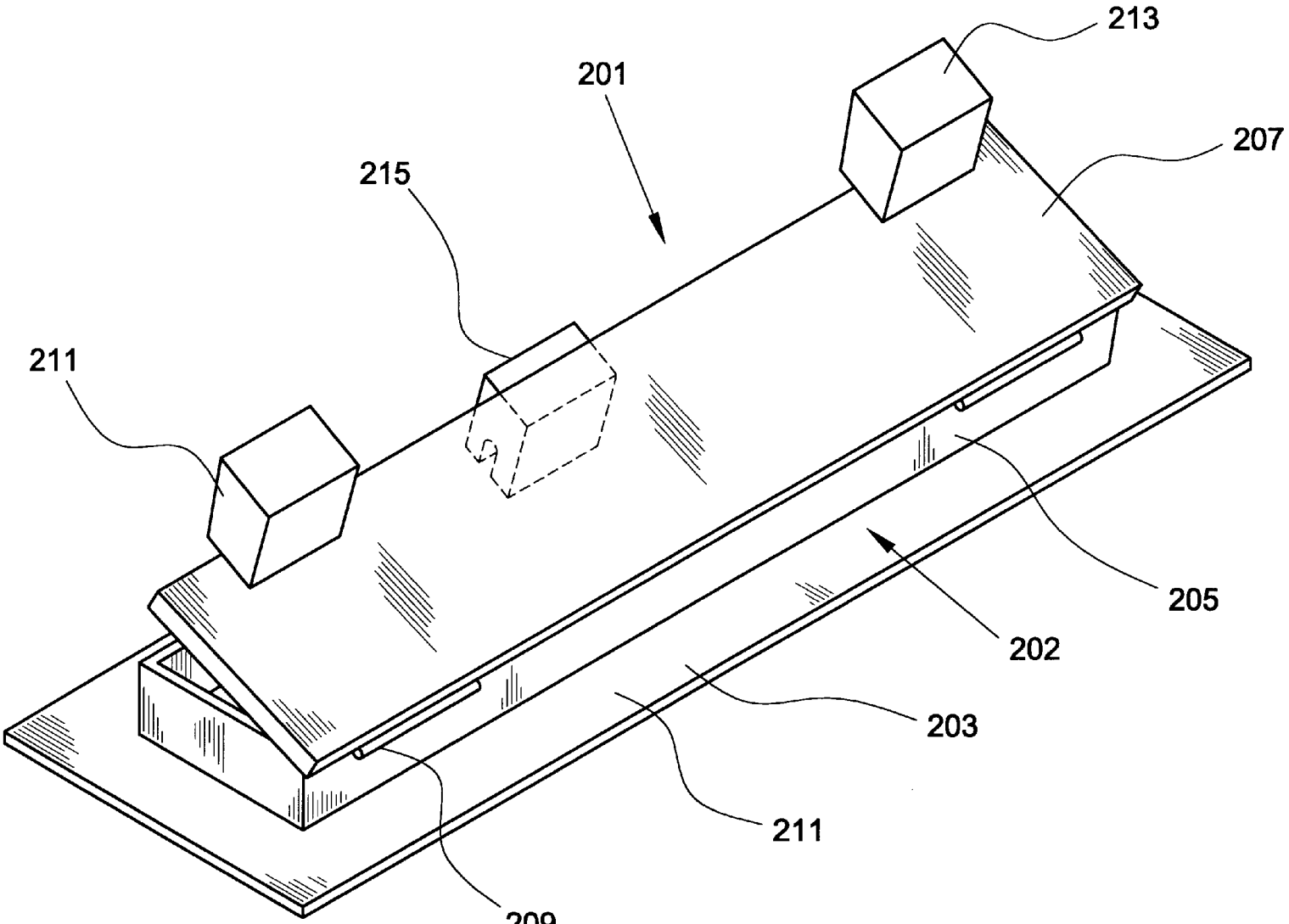
FIG. 2 illustrates a diagram of another embodiment present invention fire responsive, closing air vent which relies upon counterweights for biasing means.

FIG. 2 shows a present invention fire responsive, closing air vent 201 which relies upon counterweights for biasing means. Vent 201 is to be used in a horizontal, venting downward orientation such as in house soffits. It includes a main frame 202 which is a flat plate 203 with a rectangular airflow passageway but could be square, circular, oval or other desirable shapes. It includes a subframe 205 which is a rectangular box with side walls positioned at right angles to said flat plate 203. There is also included a cover 207 which is connected to main frame 202 at subframe 205 via hinges, such as hinge 209. There are counterweights 211 and 213 which push against cover 207 to force it downwardly to a second, closed position. However, wax block 215 is nested on the edge of subframe 205, as shown, and under cover 207 to push cover 207 upwardly to a first, open position, as shown, with spring 213 at least partially compressed.

Figure 3:
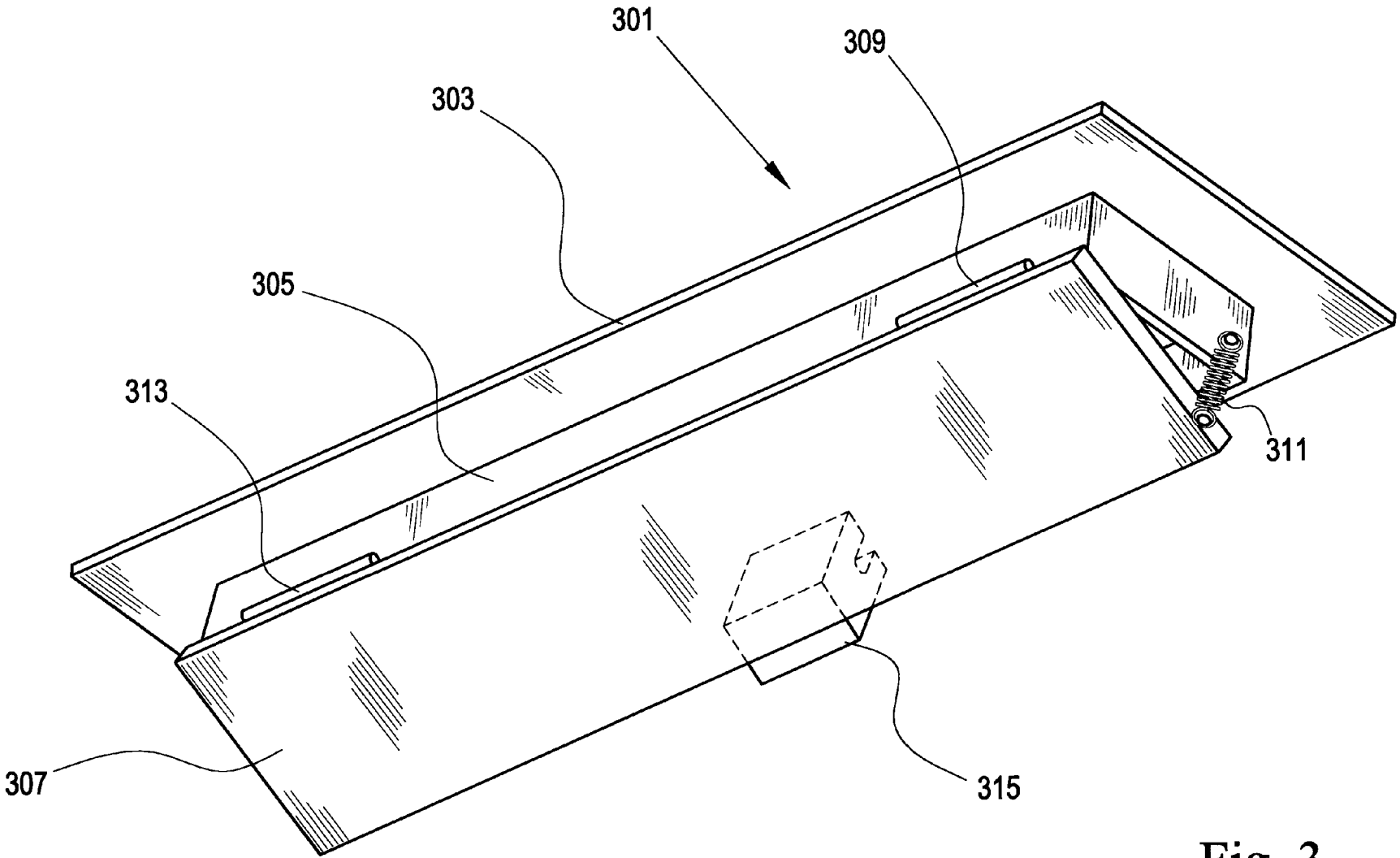
FIG. 3 illustrates an alternative embodiment of the present invention device which includes a main frame and a box-like subframe with a lid which utilizes alternative springs.

FIG. 3 shows an alternative embodiment present invention device 301 which includes a main frame 303 and a box-like subframe 305 with lid 307. This is hingedly connected to subframe 305 via hinges 313 and 309. There is a spring 311 which pulls lid 307 closed to its second, closed position. A block of low melting plastic 315 forces lid 307 open against the biasing of spring 311 to maintain lid 307 in its first, open position for venting. Polymer 315 may be any deforming or melting plastic which yields at temperatures in the range of 130° F. to 170° F. It may be heat shrinkable or deformable (such as a hydrogel polymer) or liquefiable at the temperatures. In fact, any equivalent material which will permit the closure of lid 307 in response to heat at a predetermined temperature may be used. Additionally, while block 315 is shown directly between lid 307 and 311, block 315 could maintain lid 307 in its first, open position by indirect contact. For example, it could wedge a lever which will hold lid 307 open and the lever would close lid 307 when block 315 yielded.

Figure 4:
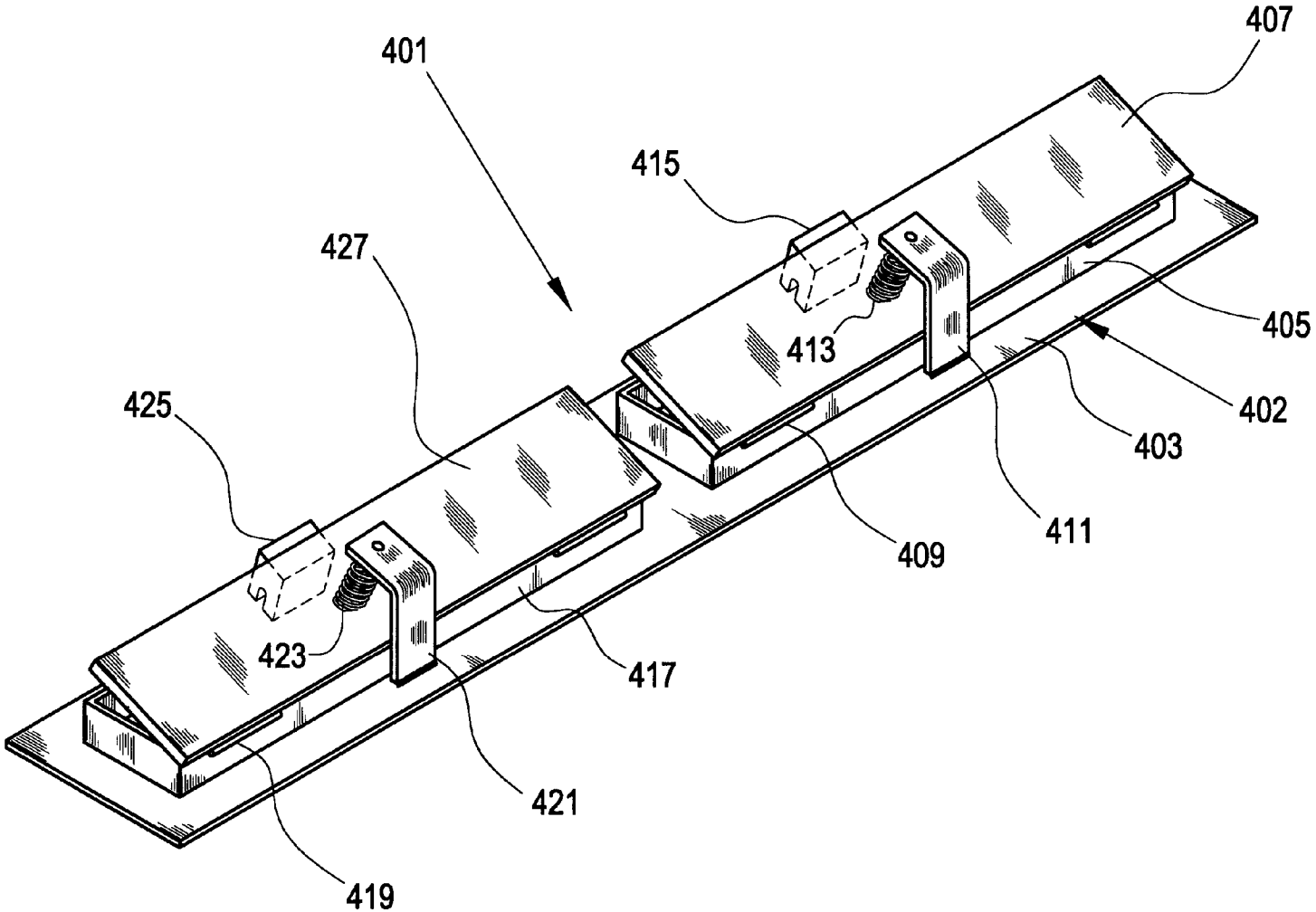
FIG. 4 illustrates a diagram of the present invention fire responsive, closing air vent which has the basic configuration of the FIG. 1 device but with plural venting.

FIG. 4 shows a present invention device 401 which has the basic configuration of the FIG. 1 device, but with plural venting. Here there is a main frame 401 with two subframes 405 and 417. Main frame 402 has a plate 403 at right angles to box-like subframes 405 and 417. There are covers 407 and 427, attached to subframes 405 and 417 via hinges such as hinges 409 and 419, respectively. Cover 407 and 427 are shown in their open position. There are metal brackets 411 and 421 with springs 413 and 423 which force covers 407 and 427 closed. However, blocks 415 and 425, deformable at 150° F. force covers 407 and 427 open. These yield to close covers 407 and 427 in response to heat at or above 150° F.

Figure 5:
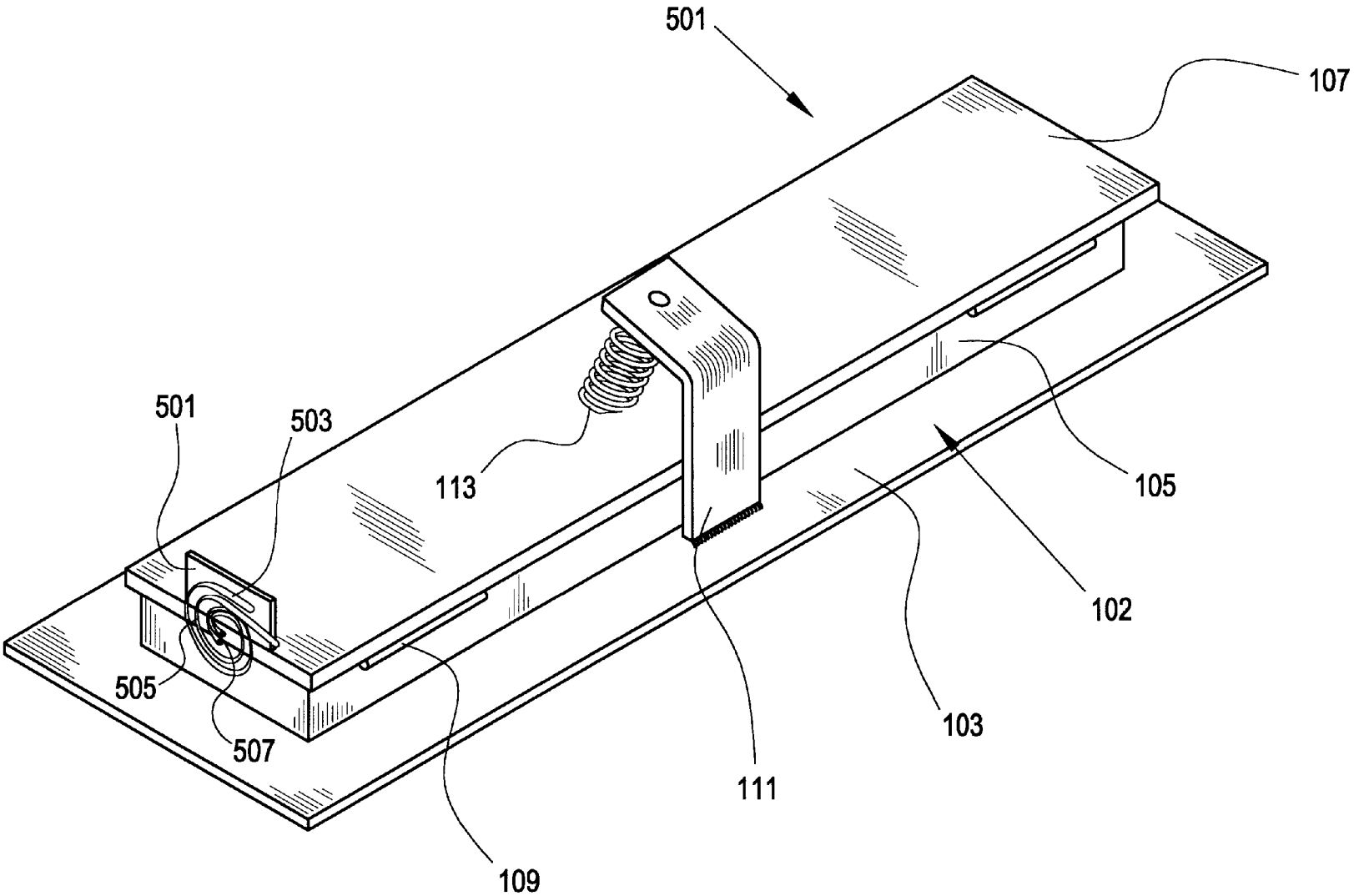
FIG. 5 illustrates a present invention device which is identical to the FIG. 1 device except for a bimetallic coil fire responsive means; and, FIG. 6 illustrates a present invention device in which both the biasing means and the fire responsive means are a single component.

FIG. 5 shows a present invention device which is identical to device 101 shown in FIG. 1 except for the fire responsive means. All parts which are identical in FIG. 1 are identically numbered. Attached to cover 107 is a vertical plate 501 and guide bracket 503. Attached to subframe 105 is bimetallic coil 505 with attachment mechanism 507 (a screw or weld bead or pin). In FIG. 5, present invention device 501 is shown exposed to heat in excess of 145° F. Thus, bimetallic coil 505 is rotated to its second position from heat. At lower temperatures bimetallic coil 505 will open, push against guide bracket 503 and open cover 107 against the closing force of spring 113.

Figure 6:
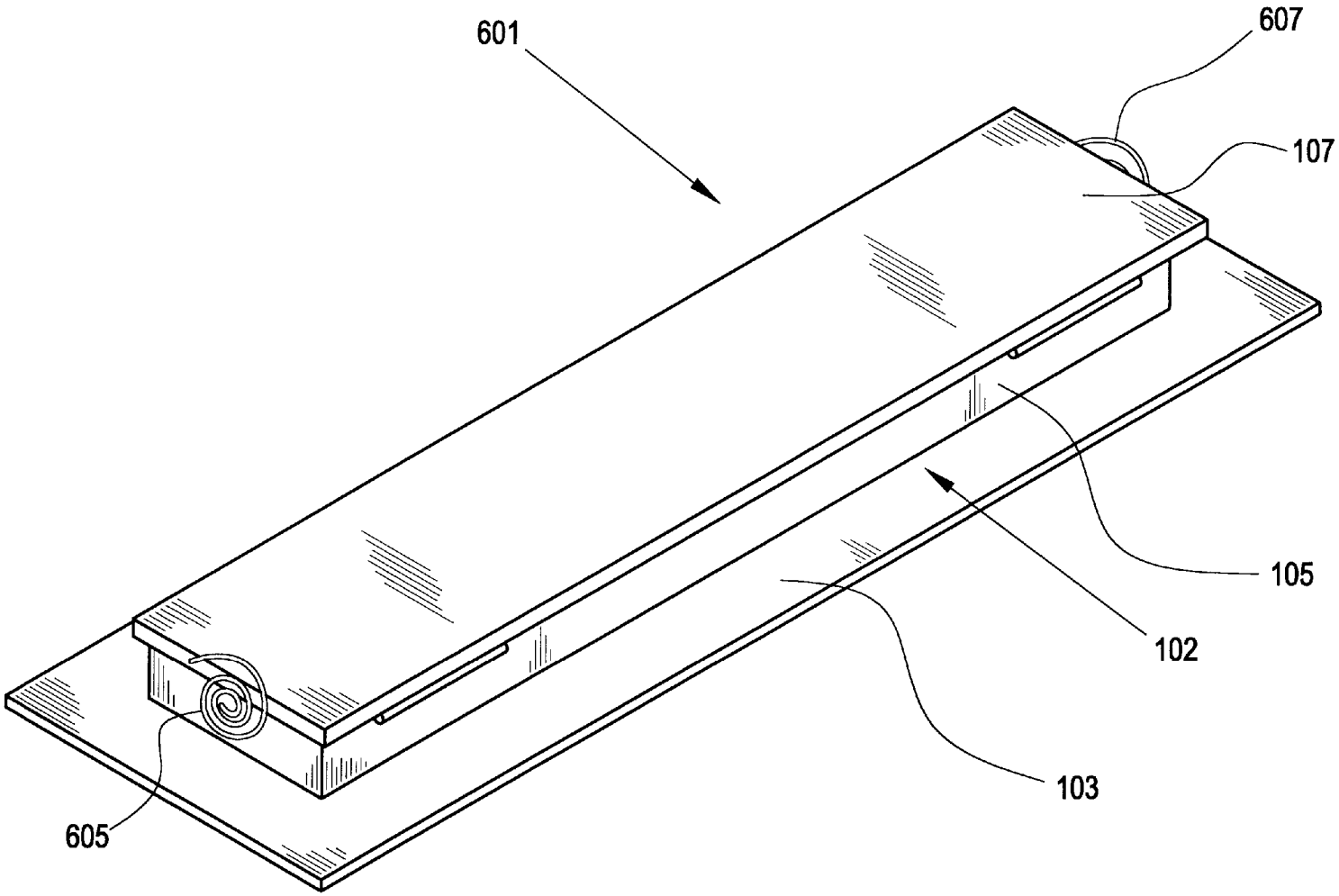

FIG. 6 shows a present invention device which is similar to the device shown in FIG. 5 except that the spring element for biasing the device to its closed position has been eliminated and the bimetallic coil is connected both to the cover and the mainframe. Thus, in FIG. 6 there is present invention device 601 which includes main frame 102 and subframe 105 with cover 107. In this case, cover 107 is directly connected to subframe 105 via bimetallic coils 605 and 607. These coils perform three separate functions—they replace hinges, they bias cover 107 to its open position in cool environments, and bias cover 107 to its closed position by responding to heat. Thus, coils 605 and 607, each connected to both subframe 105 and cover 107 act as biasing means and fire responsive means.

Obviously, numerous modifications and variations of the present invention are possible in light of the above teachings. Thus, for example, the subframes may be built right into the flat plate or may be set at angles other than right angles thereto. Likewise, the particular temperatures mentioned above are not intended to limit the scope of the present application and an artisan might set higher minimum temperatures without exceeding the scope of the present invention. It is therefore understood that within the scope of the appended claims, the invention may be practiced otherwise than as specifically described herein.

What is claimed is:

1. A fire responsive, closing air vent, which consists essentially of:

a) a substantially flat planar main frame enclosing an air flow passageway and adapted for attachment to a venting opening in a structure;

b) a hingeable cover connected to said main frame and having a first, open position and a second, closed position;

c) at least one spring which serves as a biasing means for biasing said cover towards said second, closed position; and, d) fire responsive means positioned at least in part between said frame and said cover so as to hold said cover in said first, open position, said fire responsive means being at least partially moveable in response to an increase in ambient temperature in excess of 140° F. so as to cease from holding said cover in said first, open position and permitting said at least one spring to close said cover to said second, closed position.

2. The fire responsive, closing air vent of claim 1 wherein said main frame comprises a flat plate and a subframe for insertion into a building structure and being positioned at right angles to said flat plate.

3. The fire responsive, closing air vent of claim 1 wherein said fire responsive means is a preformed mass of material which is meltable, shrinkable or deformable in response to heat above a predetermined temperature.

4. The fire responsive, closing air vent of claim 2 wherein said fire responsive means is a preformed mass of material which is meltable, shrinkable or deformable in response to heat above a predetermined temperature.

5. The fire responsive, closing air vent of claim 1 wherein said fire responsive means is a preformed mass of meltable wax.

6. The fire responsive, closing air vent of claim 2 wherein said fire responsive means is a preformed mass of meltable wax.

7. The fire responsive, closing air vent of claim 1 wherein said fire responsive means is a preformed mass of plastic.

8. The fire responsive, closing air vent of claim 2 wherein said fire responsive means is a preformed mass of plastic.

* * * * *